US006162088A

United States Patent [19]

Bonvallat et al.

[11] Patent Number: 6,162,088

[45] Date of Patent: Dec. 19, 2000

[54] METHOD AND DEVICE FOR FILLING A CAVITY FOR RECEIVING AT LEAST ONE ELECTRIC WIRE OR PLUG, WITH A SEALING GEL OR GREASE

[75] Inventors: Pierre Bonvallat, Cluses; Xavier Fasce, Marigner, both of France

[73] Assignee: Pouyet, S.A., France

[21] Appl. No.: 09/174,823

[22] Filed: Oct. 19, 1998

[30] Foreign Application Priority Data

Oct. 21, 1997 [FR] France ..... 97 13402

[51] Int. Cl.[7] ..... H01R 13/52

[52] U.S. Cl. ..... 439/521

[58] Field of Search ..... 439/521, 936, 439/426, 271, 185

[56] References Cited

U.S. PATENT DOCUMENTS 5,359,654 10/1994 Jensen et al. ..... 379/397

*Primary Examiner*—Neil Abrams
*Assistant Examiner*—Eugene G. Byrd
*Attorney, Agent, or Firm*—Richard P. Gilly

[57] ABSTRACT

The device includes channels into which sealing gel or grease can be injected from an orifice in the housing in the cavity which receives an electrical wire or plug. The channels are structured to reduce or avoid the formation of voids within the corresponding structure. A related method includes the step of injecting the sealing gel or grease via a channel and into a cavity which receives a line or wire therein.

9 Claims, 4 Drawing Sheets

METHOD AND DEVICE FOR FILLING A CAVITY FOR RECEIVING AT LEAST ONE ELECTRIC WIRE OR PLUG, WITH A SEALING GEL OR GREASE

FIELD OF THE INVENTION

The present invention relates to a method and to a device for filling a cavity for receiving at least one electric wire or plug, with a sealing gel or grease.

BACKGROUND OF THE INVENTION

It is conventional, particularly in the domain of telephone or computer-related connections, to fill the cavity or cavities for receiving the electric wires or plugs, with a sealing gel or grease.

In the case of devices, in particular of line interconnection devices, comprising insulation-displacing contacts, or "I.D.C.'s", it is furthermore often desired likewise to coat these I.D.C.'s with the sealing gel or grease.

In all these respects, the present method which consists quite simply in filling these cavities by injecting the gel or grease via their opening is not really satisfactory, as, on the one hand, the formation of air bubbles in the bottom of these cavities cannot be prevented and, on the other hand, it is difficult to coat the I.D.C.'s with this gel or grease.

It is an object of the present invention to overcome these drawbacks.

SUMMARY OF THE INVENTION

To that end, it relates to a method for filling at least one cavity for receiving at least one electric wire or plug with sealing gel or grease, the method comprising the step of injecting the gel or grease in said cavity in order to fill it via at least one auxiliary channel which opens out in the rear of said cavity.

Other auxiliary channels are advantageously also provided, which may be by-pass channels of the above-mentioned auxiliary channel or channels and which each go back along at least certain of the insulation displacing contacts which cooperate with the at least one cavity.

BRIEF DESCRIPTION OF THE DRAWINGS

The invention will be more readily understood on reading the following description with reference to the accompanying drawings, in which.

DESCRIPTION OF PREFERRED EMBODIMENT

Figure 1:
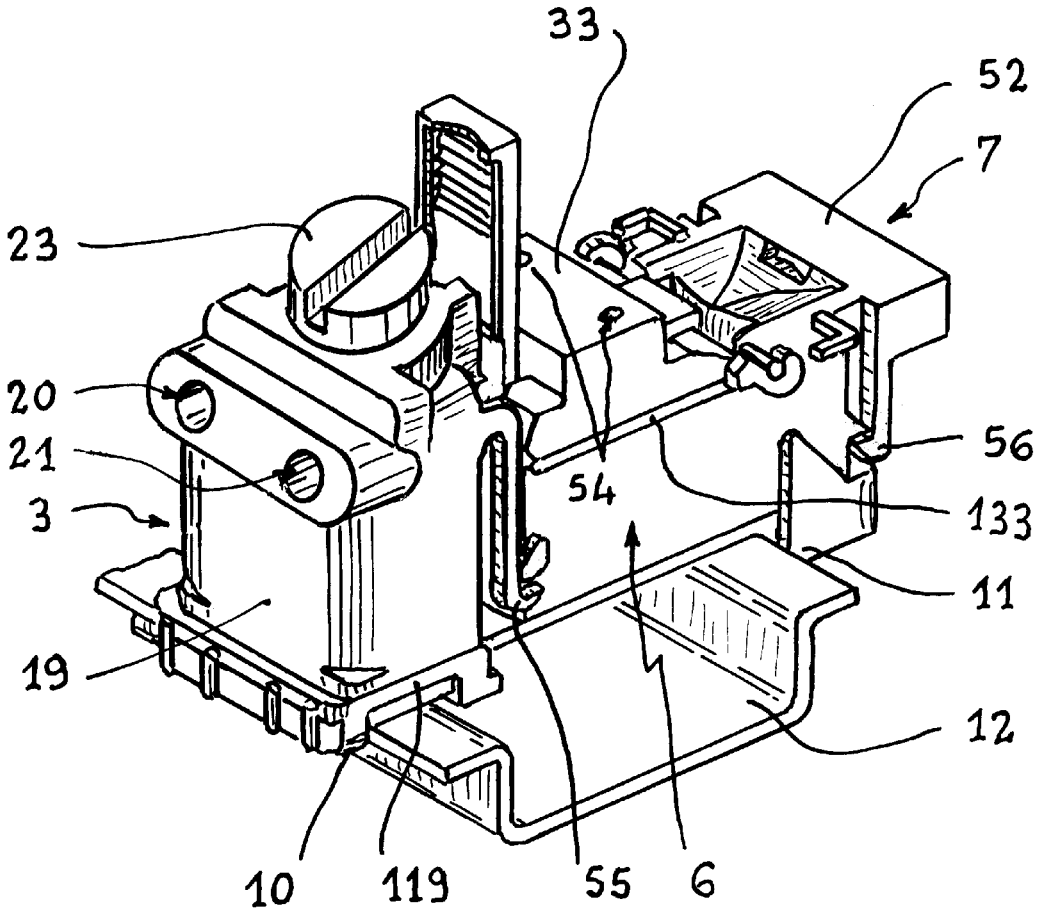
FIG. 1 is a view in perspective of a module for interconnection of two monopair telephone lines, in which gel or grease has been injected according to the invention.

Referring now to FIGS. 1 to 6, it is question of a module, having a plastic body, for interconnection of two monopair telephone or computer-related lines, for example (FIGS. 3 and 8):

- a bifilar wire 1 comprising two sheathed electric wires, called "small wires", each having a conducting core with a diameter of from 0.4 mm to about 0.8 mm (for example 0.4 mm),
- and a bifilar line 2 comprising two sheathed electric wires, called "large wires", each having a conducting core included between 0.5 and 1.1 mm (for example 0.8 mm).

Being question for example of two telephone lines, bifilar line 1 comes from the multi-line incoming cable which forms part of the telephone network, while bifilar line 2 is the outgoing line towards the subscriber.

In another configuration, the "large wire" line 2 is composed of two aerial wires coming from the telephone network, while the "small wire" line 1 is the outgoing line towards the subscriber's installation. In such a case, the "large wire" line 2 is the incoming line, while the "small wire" line 1 is the outgoing line.

Figure 2:
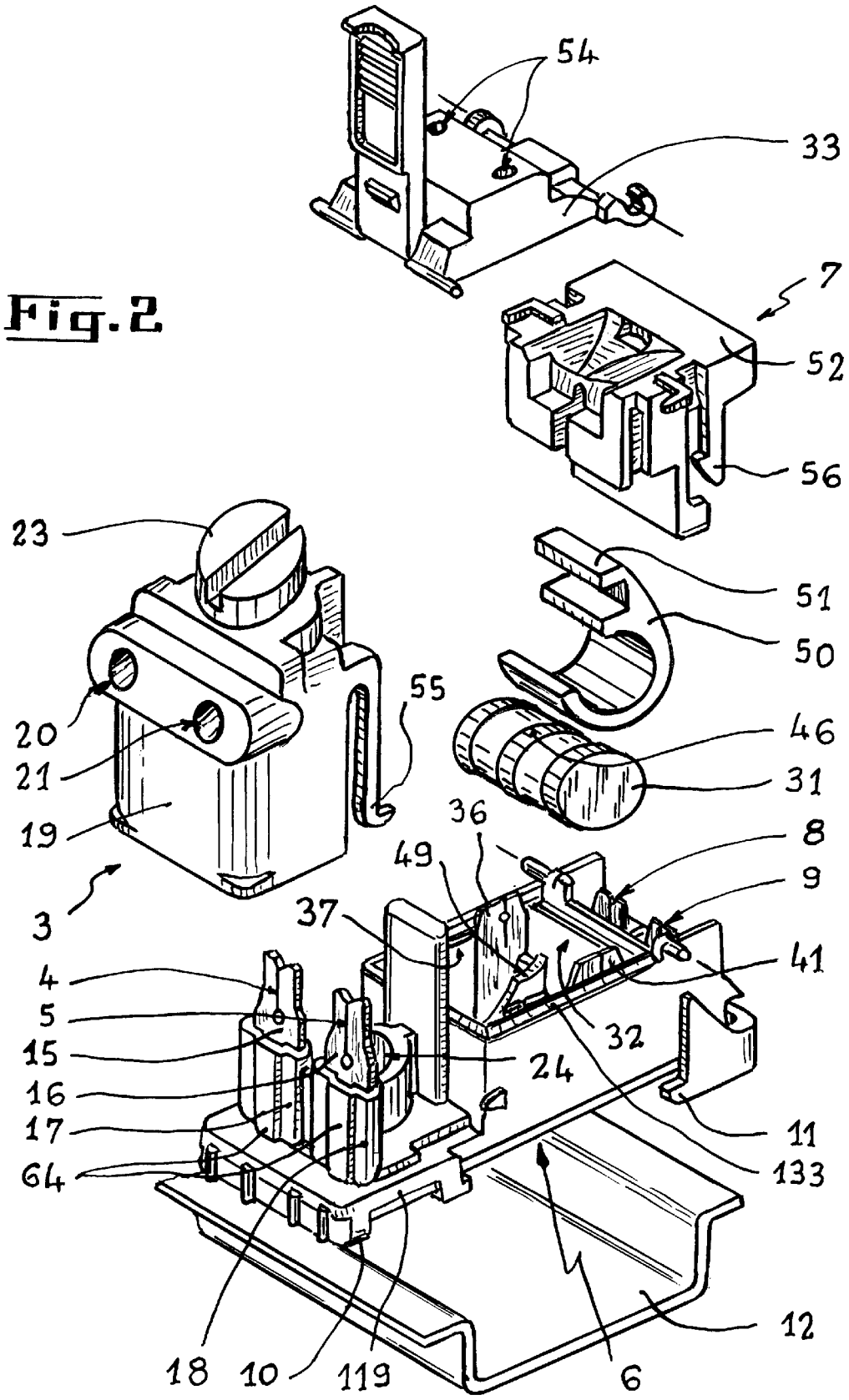
FIG. 2 is an exploded view of this same module.

This module which is a module with so-called "no tool" connection (i.e. without a tool other than a simple screwdriver), is composed in fact, in one and the same block, of three aligned portions, electrically connected together, and having clearly distinct functions. More precisely, these three aligned portions are as follows (from left to right in the accompanying Figures):

- a first portion 3, forming a first end of the alignment, whose functionality is limited to the connection of the two large wires 2 by driving-in in two respective insulation-displacing slots 4, 5 (FIG. 2);
- a second portion 6 which forms the middle of the alignment, and which constitutes the line cut-off and test zone as well as the "protection" zone receiving a lightning arrester or "excess voltage protector";
- and a third portion 7, forming the other end of the alignment, whose functionality is limited to the connection of the two small wires 1 by driving-in in two respective insulation-displacing slots 8, 9 (FIG. 2).

It should therefore be noted that portions 3, 7 for connection of the wires are therefore located on either side of the central portion 6 for cut-off, test and protection.

Like all the modules of the prior art, this module is provided to be fixed (FIG. 4), by tabs 10, 11 forming slideway, on a standardized metal rail 12.

The portion 3 for connection of the two large wires 2 comprises two I.D.C.'s 15, 16 which are placed in holding receptacles 17, 18 orthogonally with respect to the base 119 of the module. The dimensions of these contacts are adapted for receiving the large wires 2, whose core may have a diameter of up to about 1.1 mm.

There is plugged onto the assembly 15 to 18 a now conventional insulating pusher-cover 19 for receiving and connecting the two large wires by passage thereof in the respective insulation-displacing slots 4, 5 of the two I.D.C.'s 15, 16.

To that end, the pusher-cover 19 comprises two blind orifices 20, 21 for receiving the two respective large wires 2, and it is equipped with a master screw which passes through a receiver chamber 24 which forms part of the base, screwing at the bottom of this chamber in a conventional metal nut (not shown). By screwing this screw 23, the connecting cover 19 is descended, which drives the large wires 2, previously introduced in the blind orifices 20, 21, into the insulation-displacing slots 4, 5 of the two I.D.C.'s 15 and 16, which is conventional per se.

The two I.D.C.'s 15, 16 each form part of a respective complex contact 25, 26 (FIG. 6), made as a cut-out flat metal circuit, which electrically connects them, each via a longitudinal and longilinear branch 27, 28 respectively, to a test and reception contact 29, 30 of an excess voltage protector 31.

These two test contacts 29, 30 form part of the above-mentioned median portion 6 of the module.

This median portion 6 is constituted by a chamber 32 of rectangular section (FIG. 2) comprising an O-ring 133 and closed or not by a pivoting lid 33 which itself comprises, like the one described as a variant in document EP-A-0 710 040 mentioned above, two contacts 34, 35 (FIGS. 8, 4, 5) for line continuity.

When the lid 33 is closed, the contacts 34 and 35 electrically connect together:

contact 29 with a flat contact 36 which is applied, like this contact 29, against one of the two longitudinal inner surfaces 37 (FIG. 2) of the chamber 32 and which is connected, via a longitudinal connection branch 38 forming part of a complex contact 39, to a first I.D.C. 40 of the third portion 7, intended to receive one of the two small wires 1.

contact 30 with another flat contact 41, identical to contact 36 but applied on the opposite surface of the chamber, this contact 30 likewise forming part of a complex contact 42 which connects it, by a longitudinal branch 43, to the second I.D.C. 44 for receiving the second small wire 1.

Furthermore, the chamber 32 includes an earth contact 45 (FIGS. 2, 3, 6) which abuts, under the module, against the metal receiving rail 12 and which, in the chamber 32, is located halfway between the contacts 29 and 30 in order to be able to receive the median earth electrode 46 of the excess voltage protector 31 when it is in place between two advanced elastic portions 47, 48 of the respective contacts 29 and 30.

The chamber 32 presents, internally and in its middle, a suitable profile 49 for guiding the excess voltage protector 31 between its receiving contacts 47 and 48.

In addition, the excess voltage protector 31 is removably retained in insulating nippers 50. These nippers 50 comprise a manual gripping member 51 which projects beyond the opening of the chamber 32 when the protector 31 is positioned in this chamber, with these nippers 50, which then remain in the chamber with the protector which they hold. The protector 31 can in that case easily be extracted from the chamber with the aid of its holding nippers 50. When the lid 33 is closed, the protuberant gripping portion 51 is then housed in the hollow of this lid.

The third portion 7 mentioned above comprises the two I.D.C.'s 40, 44 for insulation-displacing connection of the small wires 1 as well as an insulating connection pusher 52 which is plugged on these two I.D.C.'s 40, 44.

In manner known per se in the I.D.C. technique, the pusher 52 comprises two blind orifices 53 for respectively receiving each of the small wires 1.

Conventionally, the two small wires 1 are firstly introduced in these orifices 53, the pusher 52 being raised, then the pusher is pushed manually on the I.D.C.'s 40, 44, to make it descend therealong and thus drive the two small wires 1 in their respective insulation-displacing slots 8 and 9. The pusher 52 in that case remains in place and it is then possible to disconnect the wires 1 simply by lifting this pusher to disengage these wires from the insulation-displacing slots 8, 9, in the same way as the large wires 2 may be disconnected by unscrewing the screw 23 to lift the cover 19.

It should be noted that the lid 33 may be optionally pierced, as shown, with two orifices 54 via which a respective test plug may be passed, which is known per se in other devices.

It should also be noted that both the connection cover 19 and the connection pusher 52 each present one or more end-of-connection catches 55, 56 which not only ensure, by their end-of-stroke clipping, a solid positioning of the pusher, but, by the clacking sound made by such clipping, also inform the assembler that the insulation-displacing connection is positively effected.

The chamber 32 is hermetically closed, as it is not suitable to fill it with a sealing gel if it is desired, as explained in document EP-A-0 710 040 mentioned above, to be able to effect renewable line tests with the aid of alligator clips which individually clip one or the other of the test contacts 29, 30, 36, 41.

On the other hand, the four blind orifices 20, 21, 53, 53 must preferably be filled with a sealing gel or grease, and the four I.D.C.'s 15, 16, 40, 44 must preferably be coated with such a gel or grease.

According to the present invention, this module comprises a special circuit for injection of the sealing gel or grease, through four (this number being given only by way of non-limiting example) small injection orifices provided in the base 19 of the module:

two injection orifices 57 at the front, for the sealing gel or grease which will fill, via the rear thereof, the two orifices 20, 21 for introduction of the large wires 2, and which will, in addition, coat the two I.D.C.'s 15 and 16, via a particular path, and two injection orifices 58 at the rear, for the sealing gel or grease which will fill, via the rear thereof, the two orifices 53 for introduction of the small wires 1, coating the two I.D.C.'s 40 and 44 by this operation, thanks to the existing clearances (not visible in the drawing).

Figure 3:
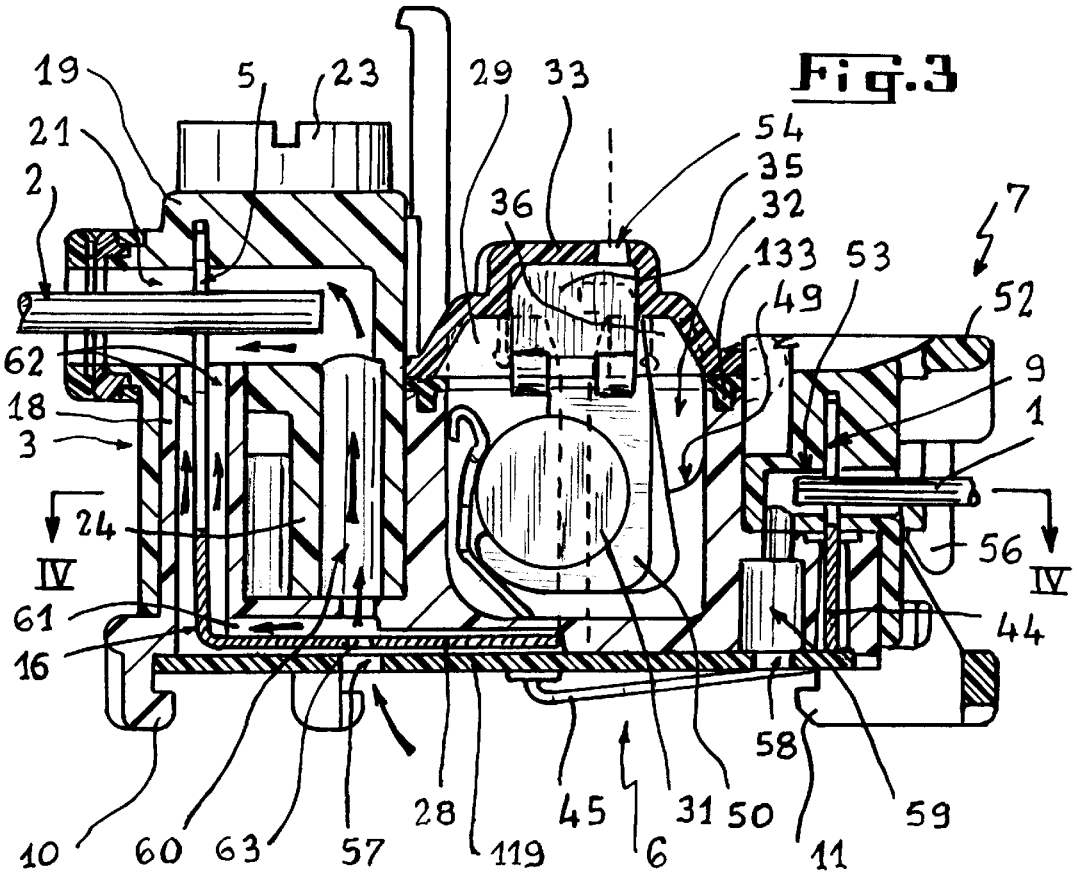
FIG. 3 is a longitudinal section along III—III of FIG. 4.
Figure 4:
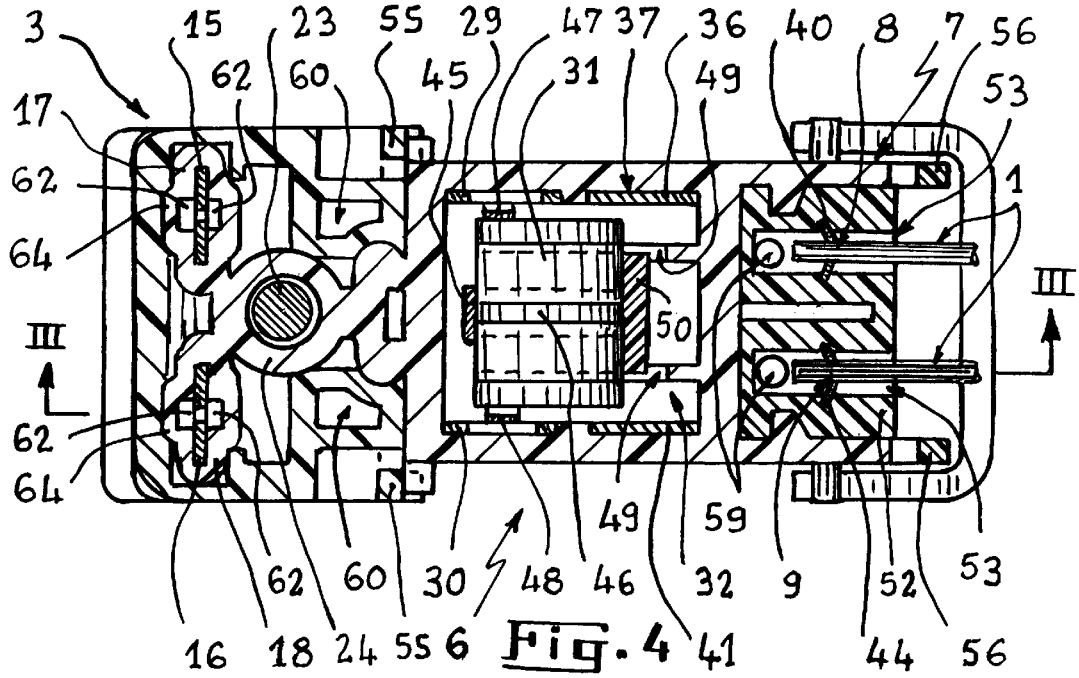
FIG. 4 is a horizontal half-section along IV—IV of FIG. 3.
Figure 5:
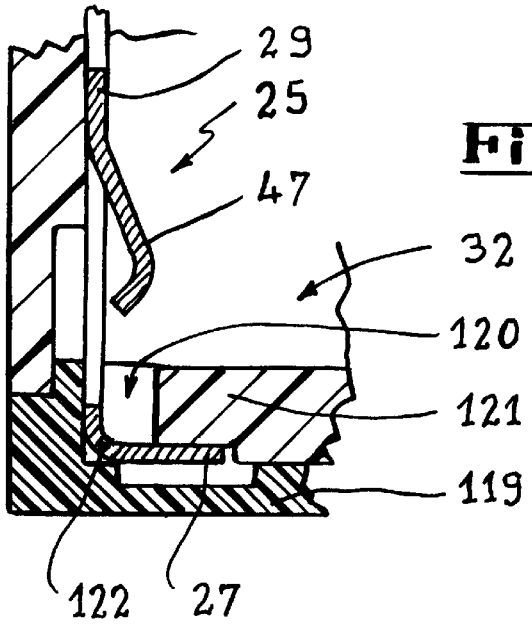
FIG. 5 is a partial transverse section made at the level of a contact for receiving an excess voltage protector.
Figure 6:
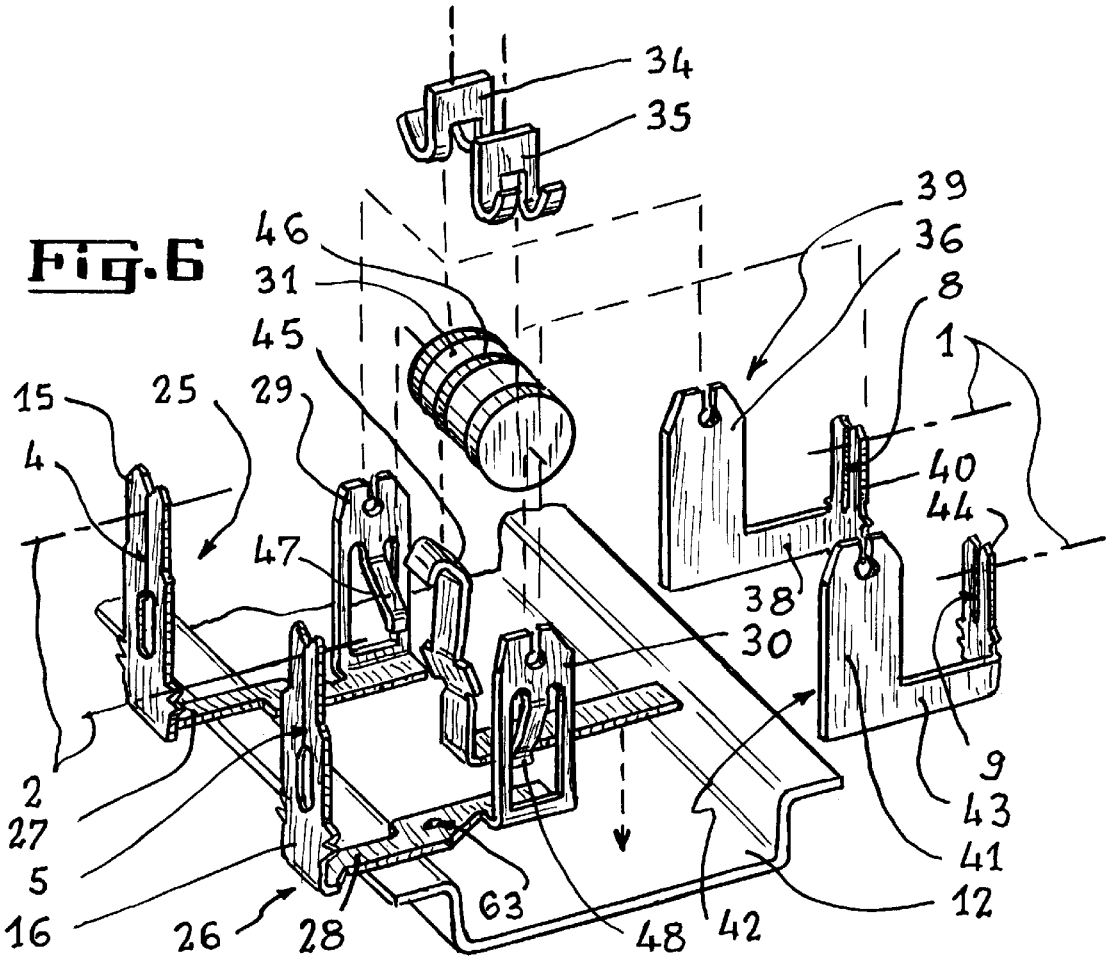
FIG. 6 is an exploded view of the internal connections of this module.

The gel- or grease-injection circuits, both at the front (large wire side) and at the rear (small wire side) of the module are clearly visible in FIGS. 3, 4 and 5.

On the small wire 1 side, the circuit is very simple. It is composed, in the alignment and axis of each of the injection orifices 58, of a respective injection channel 59 for each of the blind orifices 53. Each of these two injection channels 59 is provided to be moulded in the body of the module. It is vertical in FIG. 5, and therefore perpendicular to the blind orifice 53 in the bottom of which it opens. These two orifices 53 are filled with the gel or grease without risk of forming air bubbles.

On the large wire 2 side, the two gel or grease injection circuits are a little more complex, as they ensure not only the injection, via respective channels 60 both parallel to the two vertical channels 59 mentioned above, of the gel or grease in the bottom of the two blind orifices 20 and 21, but also, by a respective by-pass channel, these two by-pass channels each presenting a horizontal branch 61 followed by a vertical branch 62, the injection of the gel or grease along and on each of the two large faces of each I.D.C. 15 and 16.

Each channel 60 is rectilinear, like its homologue 59, and is likewise moulded in the insulating body of the module. However, it traverses the horizontal branch 27 or 28 of the respective metal contact 25 or 26 associated therewith (FIG. 6), and, to that end, this horizontal metal branch 27 and 28 is pierced with a small orifice 63 for passage of the gel or grease.

The vertical channels 62 for conducting the gel or grease along the I.D.C.'s 15 and 16 are obtained by moulding of the receptacles 17 and 18, these latter consequently presenting swells 64 (FIG. 2).

Nonetheless, it should be avoided that the gel or grease injected via the said orifice or orifices propagates towards the inside of the chamber 32. The latter must in fact remain free of gel or grease in order to be able, after its tight lid has been opened, to make the possibly repetitive tests with the aid of alligator clips or plugs as desired, without the latter being coated with such a gel or grease.

Now, as is clearly seen in FIG. 5, there must be provided, in the plastic insulating portion of the module, a relatively wide passage 120 for each advanced arm 47 for receiving a line electrode of the excess voltage protector 31.

In order to avoid the gel or grease propagating via this passage 120 in the chamber 32, the plastic body 119, 121 of the module is shaped at that spot so that, as shown, the angular flap 122 of the connecting branch 27 at that spot closes the bottom of this passage 120.

It goes without saying that the invention is not limited to the embodiment which has just been described and many other forms of embodiment can be envisaged. For example, the invention is also applicable to a line interconnection interface and to a female socket for receiving one or more male plugs for connecting one or more lines.

Likewise, the number of orifices for injection of the sealing gel or grease is not limited to four: it is quite possible for one, two, three or other number to exist.

What is claimed is:

1. A device for filling at least one cavity for receiving at least one electric wire or plug with sealing gel or grease, the device being included in a member for interconnection of lines or for connection of at least one line, the device comprising at least one orifice for injection of the gel or grease, the orifice being defined in the member and in communication with at least one channel for injecting the gel or grease, the channel opening out in the rear of the cavity in order for the wire or plug to be introduced in the member, the cavity being filled with gel or grease via the rear thereof and not via its front opening, thereby avoiding the formation of air bubbles.

2. The device of claim 1 for filling a plurality of the cavities, the device further comprising a plurality of the orifices for injecting the gel or grease respectively towards corresponding cavities defined in the member, each orifice being attached to a respective gel or grease injection circuit.

3. The device of claim 1, further comprising insulation-displacement contacts for receiving the electrical wire or plug, and by-pass channels defined in the member, and wherein the gel or grease injection circuits facilitate not only the injection of the gel or grease in the rear of the cavity but also, via respective by-pass channels, the injection of the gel or grease along the insulation-displacement contacts associated with the member.

4. The device of claim 2, wherein the member comprises a plastic body in the form of a module, a test chamber defined therein, and at least one insulation-displacement contact positioned at a defined location in communication with a corresponding passage in the test chamber, and wherein, in order to avoid the gel or grease propagating via the passage, the plastic body of the module has an angular flap at the defined location shaped so that the angular flap closes the bottom of the passage and consequently opposes the passage of the gel or grease.

5. A member for connection of at least one line, the member comprising:

an external housing having at least one opening defined therein;

a cavity extending into the housing from the opening, the cavity receiving the line therein; and a device for filling the cavity with sealing gel or grease, the device comprising:

an orifice defined in the external housing and suitably sized to receive the gel or grease; and at least one channel extending into the housing from the orifice and communicating with the cavity, the channel having means for receiving therein the gel or grease when injected through the orifice, whereby the formation of air bubbles is avoided when the cavity is filled with the gel or grease.

6. The member of claim 5, wherein the means for receiving the gel comprises a passage opening out in the rear of the cavity.

7. The member of claim 5, wherein the means for receiving the gel comprises an injection circuit.

8. The member of claim 5, further comprising insulation displacement contacts for receiving the line electrical wire and a plurality of the channels, at least one of the channels having means for receiving the gel or grease along the insulation displacement contacts.

9. The member of claim 8, wherein the means for receiving the gel or grease along the insulation displacement contacts comprises a chaiinel wall extending along each of the insulation displacement contacts and in spaced relation thereto, whereby the gel is received between the channel wall and the insulation displacement contacts.

* * * * *